United States Patent [19]

Accatino

[11] 4,293,830

[45] Oct. 6, 1981

[54] MICROSTRIP DELAY LINE COMPENSATED FOR THERMAL PHASE VARIATIONS

[75] Inventor: Luciano Accatino, Turin, Italy

[73] Assignee: CSELT, Centro Studi e Laboratori Telecomunicazioni S.p.A., Turin, Italy

[21] Appl. No.: 87,647

[22] Filed: Oct. 23, 1979

[30] Foreign Application Priority Data

Dec. 29, 1978 [IT] Italy ..... 69976 A/78

[51] Int. Cl.[3] ..... H01P 9/00; H01P 1/30

[52] U.S. Cl. ..... 333/161; 333/246

[58] Field of Search ..... 333/18, 23, 28 R, 17 R, 333/156, 157, 160, 161, 202–212, 236, 234, 238, 243, 138–140, 33; 343/778

[56] References Cited

U.S. PATENT DOCUMENTS

| | | | |
|---|---|---|---|
| 2,779,004 | 1/1957 | Bredall et al. | 333/234 |
| 3,617,955 | 11/1971 | Masland | 333/204 |
| 3,886,484 | 5/1975 | Dias et al. | 333/107 A |
| 4,019,161 | 4/1977 | Kimura et al. | 333/234 |
| 4,059,815 | 11/1977 | Makimoto et al. | 333/202 X |
| 4,112,398 | 9/1978 | Burnett et al. | 333/203 |
| 4,208,640 | 6/1980 | Van der Meijs | 333/28 R X |

OTHER PUBLICATIONS

Lance–"Introduction to Microwave Theory and Measurements", McGraw–Hill, New York, 1964; Title Page and pp. 19–22.

*Primary Examiner*—Marvin L. Nussbaum
*Attorney, Agent, or Firm*—Karl F. Ross

[57] ABSTRACT

A delay line for microwaves, whose transfer function is subject to phase variations with changes in ambient temperature, is connected in cascade with a transmission line whose phase varies in the opposite sense. The transmission line, which may be integrated with the associated delay line in a common microstrip structure, is of such length as to maintain the overall phase shift substantially constant within a certain temperature range.

5 Claims, 1 Drawing Figure

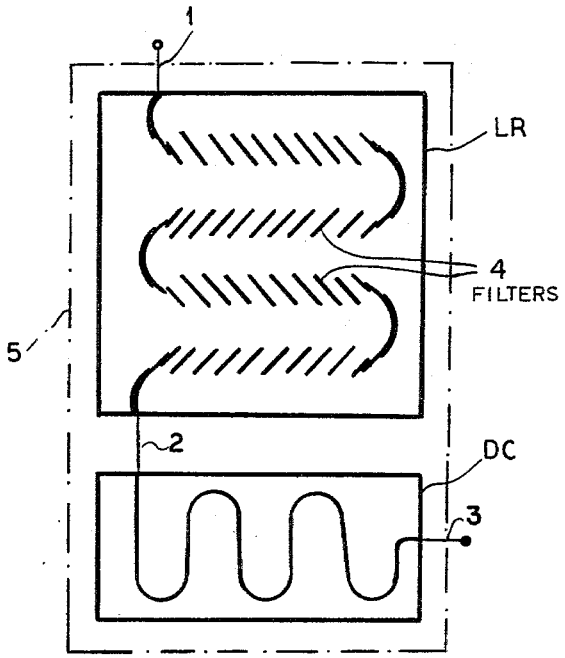
1
LR
4
FILTERS
5
2
DC
3

MICROSTRIP DELAY LINE COMPENSATED FOR THERMAL PHASE VARIATIONS

FIELD OF THE INVENTION

The present invention relates to equipment for high-frequency signal processing and more particularly to a method of and means for compensating thermal phase variations in the transfer function of a distributed-parameter two-port device such as a delay line.

BACKGROUND OF THE INVENTION

The transfer function of any two-port device or four-terminal network, no matter whether active or passive, is known to depend more or less on the temperature of the room wherein it operates. Variations in the characteristic parameters of the single individual components result in an amplitude and phase variation in the transfer function of the two-port device. This phenomenon can be of great importance in a number of cases and particularly at high frequency.

The phase variation of the transfer function often gives rise to problems more serious than the variation of the modulus as its compensation is more difficult.

In case of distributed-parameter networks phase variations are chiefly determined by:

(1) variation of the circuit geometry due to thermal expansion of the material;

(2) variation of the dielectric constant of the medium through wich a high-frequency signal propagates, with consequent variation in the propagation velocity.

Know methods able to effect an accurate compensation, designed to keep phase variation within a few electrical degrees with temperature variation within several degrees Celsius, are basically two.

A first method is that of using special materials with near-zero coefficients of both thermal expansion and dielectric-constant variation.

The second method is that of introducing into the network structure such mechanical variations with the temperature that they may compensate the overall phase variation.

In the first case the materials needed must meet a number of different requirements. More particularly, besides having extremely low thermal coefficients both of expansion and of dielectric-constant variation, they must present good high-frequency electrical characteristics chiefly in the field of microwaves, and suitable mechanical characteristics depending on their use. In addition, the production of these materials is very expensive as it requires sophisticated technologies in order to minimize, disparities in the product properties.

In the second case, phase variations in the transfer function of the two-port device are compensated by a mechanical variation in the stucture wherein propagation takes place. In this manner a variation of distributed network parameters takes place so as to cause a phase variation in a direction opposite that due to temperature influence on the circuit. However, this technique can prove rather critical in the initial adjustment, the degree of reliability is lower owing to the presence of mechanical parts in motion, and direct integration of the compensated device may be difficult in more complex systems.

OBJECT OF THE INVENTION

My invention aims at overcoming these disadvantages by compensating thermal phase variations in the transfer function of a distributed-parameter network, specifically a delay line for microwaves, with the aid of inexpensive and readily available means, enabling very accurate compensation and requiring only a simple adjustments, that can be carried out by conventional measurements of the electrical properties of the material involved.

SUMMARY OF THE INVENTION

I realize this object, pursuant to my present invention, by cascading a microstrip delay line with a microstrip transmission line whose thermal coefficient of dielectric-constant variation has a sign opposite that of the corresponding coefficient of the delay line, and by making the transmission line of a length substantially compensating for thermal phase variations of the delay line whereby the overall phase shift will be approximately temperature-independent within a predetermined temperature range.

Advantageously, the two microstrip lines are structurally integrated with each other.

BRIEF DESCRIPTION OF THE DRAWING

These and other features of the present invention will become clearer from the following description of a preferred embodiment given by way of example in connection with the accompanying drawings the sole FIGURE of which shows a delay line compensated by a transmission line.

The assembly shown in the drawing utilizes the microstrip technique and includes a delay line, lr composed of four filters 4 operating in the microwave Ku band. It is realized on a quartz substrate with low coefficient of dielectric-constant variation and is used in the differential demodulation of phase-modulated digital signals (PSK).

In order to obtain a correct demodulator operation, the phase variations in the transfer function of the delay line must be kept within ±2 electrical degrees, whereas especially aboard a satellite thermal variations can reach ±15° C. with respect to a reference value. Under these conditions, a delay line of 16 nsecs without compensation can present phase variations of the order of ±7 electrical degrees.

According to the present invention, the signal arriving at the delay line LR via an input terminal 1 is delayed and extracted at the output through a connection 2 in order to be sent to a compensation device, DC. The latter, consisting of a microstrip transmission line having a characteristic impedance equal to the reference impedence of the delay line LR, emits an output signal on a terminal 3. The two microstrip lines LR and DC may be structurally integrated with each other as schematically indicated at 5.

To obtain the required compensation, thermal phase variations in the transfer function of transmission line DC are adjusted so that they can be of the same magnitude as, but of opposite sign to, those occurring in line LR. For this purpose I provide the transmission line with a substrate of a material having the following properties:

(1) thermal coefficient of dielectric-constant variation having a sign opposite that of the material of delay line LR, (2) high dielectric constant if a transmission line of limited physical but significant electrical length is required, (3) low dielectric losses, (4) low thermal-expansion coefficient.

These characteristics are readily found in easily available materials.

Different kinds of titanates can be advantageously used for this purpose.

The use of a transmission line for the compensation of thermal phase variation is particularly advantageous as it does not require great modifications in the original design of delay line LR and can be conveniently structured according to the formula:

$$\Delta\phi = 2\pi \frac{L}{2}\left(\frac{\Delta l}{l} + \frac{1}{2}\frac{\Delta\epsilon_{eff}}{\epsilon_{eff}}\right)$$

where $\Delta\phi$ is the phase variation to be compensated,

L is the length of the transmission line, $\lambda$ is the wavelength in the medium through which propagation takes place, $\Delta l/l$ is the linear expansion coefficient, and $\Delta Eeff/Eeff$ is the thermal coefficient of variation of the effective dielectric constant (taking into account the nonhomogeneity of the medium in wich propagation takes place).

These parameters are easily ascertained by means of normal material measurements to enable a determination of the only unknown parameter, i.e. the length L of the line DC.

I claim:

1. A method of transmitting microwaves along a signal path with a substantially temperature-independent phase shift within a predetermined temperature range, comprising the steps of cascading a microstrip delay line having a first thermal coefficient of dielectric-constant variation with a microstrip transmission line having a second thermal coefficient of dielectric-constant variation of a sign opposite that of said first thermal coefficient, and making said transmission line of a length substantially compensating for thermal phase variations of said delay line within said predetermined temperature range.

2. A device for transmitting microwaves between an input terminal and an output terminal with a substantially temperature-independent phase shift within a predetermined temperature range, comprising a microstrip delay line connected to said input terminal and a microstrip transmission line connected in cascade with said delay line to said output terminal, said delay line and said transmission line having thermal coefficients of dielectric-constant variation which are of mutually opposite sign, said transmission line having a length substantially compensating for thermal phase variations of said delay line within said predetermined temperature range.

3. A device as defined in claim 2 wherein said delay line and said transmission line are structurally integrated with each other.

4. A device as defined in claim 2 or 3 wherein said delay line incorporates filter means.

5. A device as defined in claim 4 wherein said delay line and said transmission line comprise substrates of quartz and of titanate, respectively.

* * * * *